US007707748B2

(12) United States Patent
Campbell

(10) Patent No.: US 7,707,748 B2
(45) **Date of Patent: *May 4, 2010**

(54) FLEXIBLE FOOT-SUPPORT STRUCTURES AND PRODUCTS CONTAINING SUCH SUPPORT STRUCTURES

(75) Inventor: Derek Campbell, Portland, OR (US)

(73) Assignee: Nike, Inc., Beaverton, OR (US)

( * ) Notice: Subject to any disclaimer, the term of this patent is extended or adjusted under 35 U.S.C. 154(b) by 430 days.

This patent is subject to a terminal disclaimer.

(21) Appl. No.: 11/360,997

(22) Filed: Feb. 24, 2006

(65) Prior Publication Data

US 2007/0199211 A1 Aug. 30, 2007

(51) Int. Cl.
*A43B 13/12* (2006.01)
*A43B 1/00* (2006.01)

(52) U.S. Cl. ..... 36/102; 36/30 R

(58) Field of Classification Search ..... 36/102, 36/30 R, 25 R, 31, 103, 28
See application file for complete search history.

(56) References Cited

U.S. PATENT DOCUMENTS

| | | | | |
|---|---|---|---|---|
| 1,853,990 | A | 4/1932 | Oakley | |
| 2,211,057 | A | 8/1940 | Duckoff | |
| 2,547,480 | A * | 4/1951 | McDaniel | 36/19 R |
| 2,897,611 | A | 8/1959 | Schaller | |
| 4,283,865 | A | 8/1981 | Dassler | |
| 4,309,376 | A | 1/1982 | Ueno et al. | |
| 4,481,727 | A | 11/1984 | Stubblefield | |
| 4,624,061 | A * | 11/1986 | Wezel et al. | 36/30 A |
| 4,676,010 | A | 6/1987 | Cheskin | |
| 4,779,361 | A * | 10/1988 | Kinsaul | 36/102 |
| 4,885,851 | A | 12/1989 | Peterson | |
| 5,024,007 | A | 6/1991 | DuFour | |
| 5,044,096 | A | 9/1991 | Polegato | |
| 5,832,636 | A | 11/1998 | Lyden et al. | |

(Continued)

FOREIGN PATENT DOCUMENTS

DE 20 2005 013282 U1 12/2005

(Continued)

OTHER PUBLICATIONS

International Search Report in corresponding PCT Application; International Application No. PCT/US2007/003107, mailed Jul. 16, 2007 (7 pages).

(Continued)

*Primary Examiner*—Ted Kavanaugh
(74) *Attorney, Agent, or Firm*—Banner & Witcoff, Ltd.

(57) ABSTRACT

Support structures for footwear and the like include a contacting member (e.g., an outsole) that includes at least two recessed segments extending in a longitudinal direction in the forefoot portion. The recessed segments provide lines of flex such that various regions of the contacting member independently move about the lines of flex and separately engage/disengage from a contact surface when a wearer shifts his/her weight. Additionally or alternatively, the contacting member may include a set of traction members in the forefoot portion that inhibit forefoot movement in a lateral direction while optionally allowing forefoot movement in a medial direction and a set of traction members in a heel portion that inhibit heel movement in the medial direction while optionally allowing heel movement in the lateral direction. Such support structures may be used, e.g., for golf shoes or shoes for other activities requiring a swinging or twisting action.

45 Claims, 9 Drawing Sheets

U.S. PATENT DOCUMENTS

| | | | | |
|---|---|---|---|---|
| 5,906,872 | A | 5/1999 | Lyden et al. | |
| 6,016,613 | A | 1/2000 | Campbell et al. | |
| 6,098,313 | A | 8/2000 | Skaja | |
| 6,108,943 | A | 8/2000 | Hudson et al. | |
| 6,158,151 | A | 12/2000 | Won | |
| 6,354,022 | B2 | 3/2002 | Gelsomini | |
| 6,357,146 | B1 | 3/2002 | Wordsworth et al. | |
| 6,477,791 | B2 | 11/2002 | Luthi et al. | |
| 6,705,027 | B1 | 3/2004 | Campbell | |
| 6,817,117 | B1 | 11/2004 | Campbell | |
| 6,857,205 | B1 | 2/2005 | Fusco et al. | |
| 6,892,479 | B2 | 5/2005 | Auger et al. | |
| 6,904,707 | B2 | 6/2005 | McMullin | |
| 6,931,768 | B2 | 8/2005 | Baek | |
| 6,948,264 | B1 | 9/2005 | Lyden | |
| 6,990,755 | B2 * | 1/2006 | Hatfield et al. | 36/97 |
| 7,181,868 | B2 | 2/2007 | Auger et al. | |
| 7,191,550 | B2 | 3/2007 | Baek | |
| 2001/0016993 | A1 | 8/2001 | Cagner | |
| 2001/0032400 | A1 * | 10/2001 | Brooks | 36/102 |
| 2003/0131501 | A1 | 7/2003 | Erickson et al. | |
| 2003/0188458 | A1 | 10/2003 | Kelly | |
| 2005/0076536 | A1 | 4/2005 | Hatfield et al. | |
| 2005/0108902 | A1 | 5/2005 | McMullin | |
| 2005/0150134 | A1 | 7/2005 | Issler | |
| 2005/0262739 | A1 | 12/2005 | McDonald et al. | |
| 2006/0242863 | A1 | 11/2006 | Patmore | |
| 2007/0169379 | A1 * | 7/2007 | Hazenberg et al. | 36/102 |
| 2007/0199211 | A1 | 8/2007 | Campbell | |
| 2008/0216352 | A1 | 9/2008 | Baucom et al. | |
| 2009/0056166 | A1 | 3/2009 | Edy et al. | |
| 2009/0056169 | A1 | 3/2009 | Robinson, Jr. et al. | |

FOREIGN PATENT DOCUMENTS

| | | |
|---|---|---|
| WO | 2006016254 A2 | 2/2006 |

OTHER PUBLICATIONS

Office Action issued Aug. 28, 2009 in corresponding Chinese Patent Application No. 200780010018.8, and English translation thereof.

* cited by examiner

FLEXIBLE FOOT-SUPPORT STRUCTURES AND PRODUCTS CONTAINING SUCH SUPPORT STRUCTURES

FIELD OF THE INVENTION

This invention relates generally to flexible support elements useful in articles of footwear and other foot-receiving device products.

BACKGROUND

Conventional articles of footwear, including athletic footwear, have included two primary elements, namely an upper member and a sole structure. The upper member provides a covering for the foot that securely receives and positions the foot with respect to the sole structure. In addition, the upper member may have a configuration that protects the foot and provides ventilation, thereby cooling the foot and removing perspiration. The sole structure generally is secured to a lower portion of the upper member and generally is positioned between the foot and a contact surface (which may include any foot or footwear contact surface, including but not limited to: ground, grass, dirt, sand, snow, ice, tile, flooring, carpeting, synthetic grass, artificial turf, and the like). In addition to attenuating contact surface reaction forces, the sole structure may provide traction and help control foot motion, such as pronation. Accordingly, the upper member and the sole structure operate cooperatively to provide a comfortable structure that is suited for a variety of ambulatory activities, such as walking and running.

The sole structure of athletic footwear, in at least some instances, will exhibit a layered configuration that includes a comfort-enhancing insole, a resilient midsole (e.g., formed, at least in part, from a polymer foam material), and a contact surface-contacting outsole that provides both abrasion-resistance and traction. The midsole, in at least some instances, will be the primary sole structure element that attenuates contact surface reaction forces and controls foot motion. Suitable polymer foam materials for at least portions of the midsole include ethylvinylacetate ("EVA") or polyurethane ("PU") that compress resiliently under an applied load to attenuate contact surface reaction forces. Conventional polymer foam materials are resiliently compressible, in part, due to the inclusion of a plurality of open or closed cells that define an inner volume substantially displaced by gas.

SUMMARY

The following presents a general summary of aspects of this invention in order to provide a basic understanding of at least some aspects of the invention. This summary is not an extensive overview of the invention. It is not intended to identify key or critical elements of the invention or to delineate the scope of the invention. The following summary merely presents some concepts relating to the invention in a general form as a prelude to the more detailed description provided below.

Aspects of this invention relate to foot support elements and products in which they are used (such as support structures for footwear or other foot-receiving device products, and the like). Foot-supporting members (e.g., sole structures and/or portions thereof) for foot-receiving device products (e.g., articles of footwear, including athletic footwear) in accordance with at least some examples of this invention may include a contact surface-contacting member (e.g., an outsole member) including a first major surface for contacting a contact surface and a second major surface opposite the first major surface. The first major surface may include: (i) a base level, (ii) a first recessed segment extending toward the second major surface and in a longitudinal direction in a forefoot portion of the contact surface-contacting member, and (iii) a second recessed segment extending toward the second major surface and in the longitudinal direction in the forefoot portion. The first and second recessed segments may provide lines of flex in the contact surface-contacting member and divide at least the forefoot portion of this member into medial, central, and lateral regions, wherein the medial, central, and lateral regions are movable about the lines of flex to independently engage and disengage from a contact surface, e.g., as a dynamic force moves laterally across the second major surface (e.g., as a wearer shifts his/her weight while wearing a shoe including this type of sole structure).

Additional aspects of this invention relate to foot-supporting members (e.g., sole structures) for foot-receiving devices (e.g., articles of footwear) that include various traction member arrangements (e.g., sets of spikes, cleats, or other traction elements provided on a ground surface-contacting member or outsole member). Such foot-supporting members may include: (a) a contact surface-contacting member (e.g., an outsole member) including a forefoot portion, a heel portion, a lateral side, and a medial side, optionally with the lines of flex as described above; (b) a first set of traction members in the forefoot portion, the first set of traction members configured to inhibit forefoot movement in a lateral direction while optionally allowing forefoot movement in a medial direction; and (c) a second set of traction members in a heel portion, the second set of traction members configured to inhibit heel movement in the medial direction while optionally allowing heel movement in the lateral direction.

Support structures of the types described above can be advantageous, at least in some examples of the invention, by providing stable support during a twisting or rotational action and by allowing a wearer's foot to maintain a relatively large contact area with the contact surface as the wearer's weight shifts and/or the wearer's foot moves. For example, during a golf swing or other swinging actions and/or during a step, a wearer's weight tends to shift, e.g., moving from the medial side to the lateral side, moving from the lateral side to the medial side, moving from the front to back, and/or moving from the back to front. Support structures of the types described above can allow independent movement of the lateral, medial, central, and/or other regions of the contact surface-contact member (e.g., independent movement or rotation about the lines of flex) and/or stable support during torsional rotation around the leg or foot, to thereby allow more of the contact surface-contacting member to remain in contact with the ground and to provide a solid base or support for the swing, step, or other movement or activity.

Still additional aspects of this invention relate to foot-receiving device products, such as articles of footwear, that include foot-supporting members, e.g., of the various types described above.

BRIEF DESCRIPTION OF THE DRAWINGS

A more complete understanding of the present invention and certain advantages thereof may be acquired by referring to the following detailed description in consideration with the accompanying drawings, in which like reference numbers indicate like features, and wherein.

DETAILED DESCRIPTION

Figure 1A:
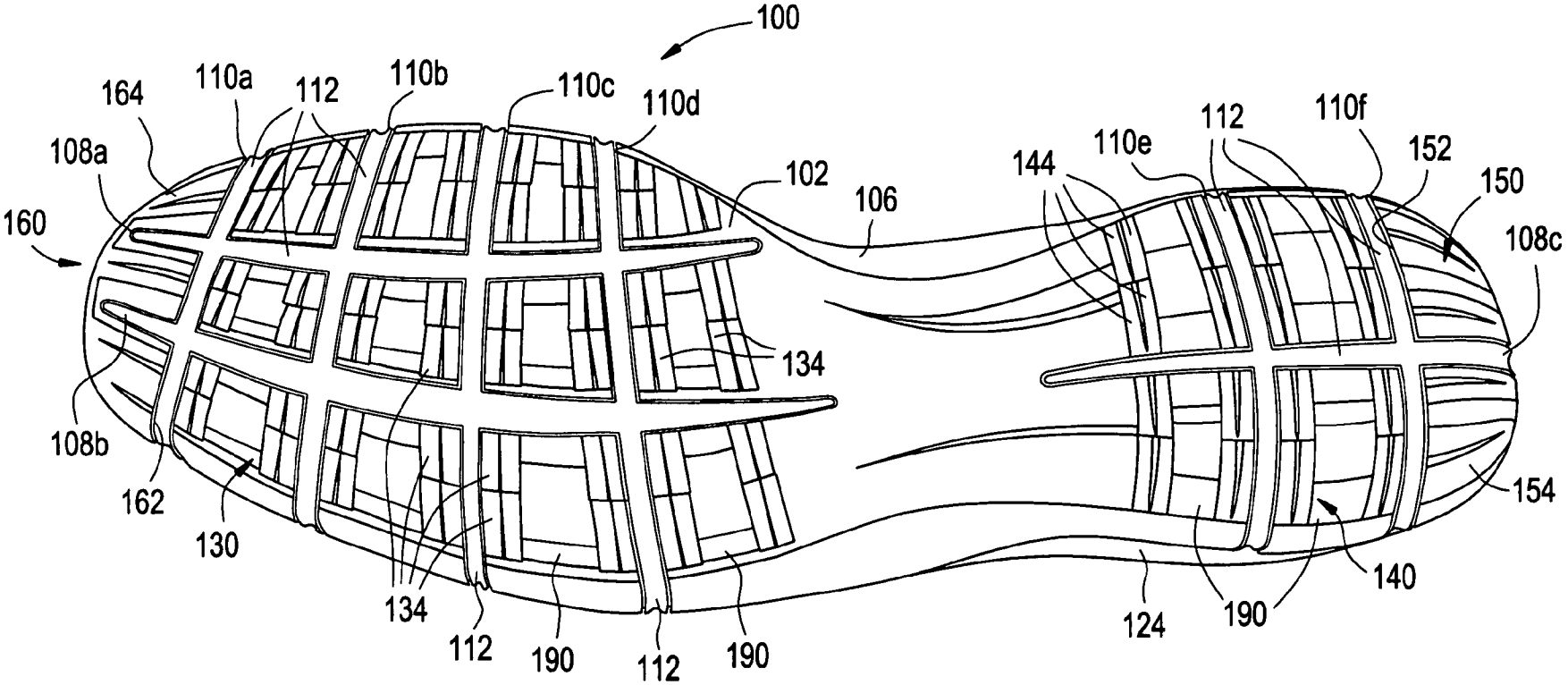
FIG. 1A illustrates a bottom (exterior) plan view of a sole structure according to at least some examples of this invention.

In the following description of various examples of the invention, reference is made to the accompanying drawings, which form a part hereof, and in which are shown by way of illustration various example structures and environments in which aspects of the invention may be practiced. It is to be understood that other specific arrangements of parts, example structures, and environments may be utilized and structural and functional modifications may be made without departing from the scope of the present invention. Also, while the terms "top," "bottom," "side," "front," "back," "above," "below, ""under," "over," and the like may be used in this specification to describe various example features and elements of structures the invention, these terms are used herein as a matter of convenience, e.g., based on the example orientations shown in the figures and/or a typical orientation during use. Nothing in this specification should be construed as requiring a specific three dimensional orientation of structures in order to fall within the scope of this invention.

To assist the reader, this specification is broken into various subsections, as follows: Terms; General Background Information Relating to the Invention; General Description of Foot Support Structures and Associated Products According to the Invention; Specific Examples of the Invention; and Conclusion.

A. Terms

The following terms are used in this specification, and unless otherwise noted or clear from the context, these terms have the meanings provided below.

"Foot-receiving device" means any device into which a user places at least some portion of his or her foot. In addition to all types of footwear (described below), foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like.

"Footwear" means any type of product worn on the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, etc.), and the like. "Footwear" may protect the feet from the environment and/or enhance a wearer's performance (e.g., physically, physiologically, medically, etc.).

"Foot-covering members" include one or more portions of a foot-receiving device that extend at least partially over and/or at least partially cover at least some portion of the wearer's foot, e.g., so as to assist in holding the foot-receiving device on and/or in place with respect to the wearer's foot. "Foot-covering members" include, but are not limited to, upper members of the type provided in some conventional footwear products.

"Foot-supporting members" include one or more portions of a foot-receiving device that extend at least partially beneath at least some portion of the wearer's foot, e.g., so as to assist in supporting the foot and/or attenuating the reaction forces to which the wearer's foot would be exposed, for example, when stepping down in the foot-receiving device.

"Foot-supporting members" include, but are not limited to, sole members of the type provided in some conventional footwear products. Such sole members may include conventional outsole, midsole, and/or insole members.

"Contact surface-contacting elements" or "members" include at least some portions of a foot-receiving device structure that contact the ground or any other surface in use, and/or at least some portions of a foot-receiving device structure that engage another element or structure in use. Such "contact surface-contacting elements" may include, for example, but are not limited to, outsole elements provided in some conventional footwear products. "Contact surface-contacting elements" in at least some example structures may be made of suitable and conventional materials to provide long wear, traction, and protect the foot and/or to prevent the remainder of the foot-receiving device structure from wear effects, e.g., when contacting the ground or other surface in use.

B. General Background Information Relating to the Invention

During a golf swing (or other swinging activities), a player's weight tends to shift as the club or other object is swung. For example, during a typical golf swing, several weight shifts and center of gravity position changes occur. More specifically, when at the ball address position of a typical golf swing (prior to initiation of the swing), the golfer's weight tends to be relatively centered on the balls of his/her feet, perhaps with the weight or center of gravity located slightly more toward the front foot than the rear foot. As the golf swing begins, the golfer takes the club back (during the backswing), which tends to move weight away from the front foot and predominantly toward the rear foot. In many instances, at the top of the backswing, the majority of the golfer's weight will be located on the lateral (outside) of the rear forefoot portion and/or on the heel portion of the rear foot (optionally, at least in some instances, the weight may be somewhat on the medial (inside) of the rear foot heel).

As the swing transitions from backswing to downswing, a rotational or torsional force may be applied to the rear foot (e.g., rotation about an axis extending through the leg or foot) as the player pushes off with the rear foot and leg and the player's weight shifts toward his/her front foot. By the impact position (when the club head again reaches the ball), the player's weight typically has almost completely shifted to his/her front foot (and particularly to the lateral side of the front foot), both at the heel portion of the front foot and the forefoot portion of the front foot (e.g., with a significant amount of weight applied approximately at the fifth metatarsophalangeal area of the front foot). Little weight may be present on the rear foot at this impact position, and in fact, in many instances for many players, at least the heel of the rear foot may have begun to lift from the ground, thereby placing whatever weight is present on the rear foot toward the toe or forefoot portion of that foot. Finally, when the club reaches the swing follow-through position (e.g., over the player's front shoulder), the weight may remain completely or at least predominantly on the front foot, particularly along the lateral heel and/or arch areas, and the rear foot may be oriented essentially vertically with only the front toe portion in contact with the ground. Some golfers actually may be able to freely lift up the rear foot without losing balance when in the follow-through position.

Because of the weight shift and/or center of gravity location change features of the typical golf swing, golf shoes typically have included spikes, cleats, or other types of traction elements, in an effort to provide traction and support for the player during a swing. While helpful, such traction elements can be of limited value, particularly as the player's foot begins to lose contact with the ground (e.g., as the player pushes against the rear foot during the beginning of the downswing, as the player rolls forward on the front foot immediately before, during, and after contact with the ball, during the follow-through, etc.). In other words, spikes, cleats, or other traction elements cannot help provide traction or support when they are not in contact with the ground.

At least some aspects of the present invention help improve traction and provide a stable and solid support for wearers during swings, steps, and/or other weight shifting activities.

C. General Description of Foot Support Structures and Associated Products According to the Invention 1. Foot Support Structures Including Flexible Contact Surface-Contacting Members In general, aspects of this invention relate to foot support elements and products in which they are used (such as support structures for footwear or other foot-receiving device products). Foot-supporting members (e.g., sole structures and/or portions thereof) for foot-receiving device products (e.g., articles of footwear, including athletic footwear) in accordance with at least some examples of this invention may include a contact surface-contacting member (e.g., an outsole member) including a first major surface (e.g., an exterior surface) for contacting a contact surface and a second major surface (e.g., an interior surface) opposite the first major surface. The first major surface may include: (i) a base level, (ii) a first recessed segment extending toward the second major surface and in a longitudinal direction in a forefoot portion of the contact surface-contacting member, and (iii) a second recessed segment extending toward the second major surface and in the longitudinal direction in the forefoot portion. The first and second recessed segments may provide lines of flex in the contact surface-contacting member and divide the forefoot portion of this member into medial, central, and lateral regions, wherein the medial, central, and lateral regions are movable with respect to one another about the lines of flex to independently engage and disengage from a contact surface as a dynamic force moves laterally across the second major surface (e.g., as a wearer shifts his/her weight while wearing the shoe or other foot-receiving device).

The first major surface may include one or more additional recessed segments extending toward the second major surface, e.g., extending in the longitudinal direction in a heel portion of the contact surface-contacting member, extending in a lateral direction in the heel portion of the contact-surface contacting member, extending in a lateral direction in the forefoot portion of the contact-surface contacting member, extending in other directions, etc. The recessed segments additionally may include a material therein (e.g., at least partially filling one or more of the recessed segments), such as a material softer than that making up the contact surface-contacting portion. If desired, the same or different materials may be provided in the various recessed segments and/or the various recessed segments may be filled with the fill material to differing extents. Also, if desired, some recessed segments on a given foot-receiving device product may be at least partially filled while others on the same product remain unfilled.

Foot support structures in accordance with at least some examples of this invention may include additional structural elements and features. For example, foot-supporting members (e.g., sole structures) according to at least some examples of this invention may include one or more impact-attenuating members (e.g., midsole structures), an innersole board structure, an insole member, a heel counter, an inflated bladder, a sock liner, traction elements, etc., engaged with the contact-surface contacting member. Such additional elements, such as the impact-attenuating members and/or the innersole board members, may include a first major surface at least partially engaged with the second major surface of the contact surface-contacting member, and a second major surface opposite its first major surface. If desired, at least the second major surface of the impact-attenuating member and/or the innersole board or other member may include one or more lines of flex, e.g., corresponding to at least some of the locations of the various recessed segments provided in the contact surface-contacting member. If desired, a given support structure may include multiple impact-attenuating members or other structures (e.g., both a midsole and an innersole board), and if further desired, any or all of these individual members may include lines of flex, e.g., corresponding to the locations of at least some of the recessed segments.

Flexible support structures of the types described above can be advantageous, at least in some examples of the invention, by allowing a wearer's foot to maintain a relatively large contact area with the contact surface as the wearer's weight shifts and/or the wearer's foot moves. For example, during a golf swing (or other swinging activities), weight tends to shift, e.g., the wearer's center of gravity moves from the medial side to the lateral side and/or moves from the lateral side to the medial side. The flexible support structures of the types described above can allow independent movement of the lateral, medial, and/or central regions of the contact surface-contact member (e.g., independent movement or rotation with respect to one another about the lines of flex) in at least some structures to thereby allow more of the contact surface-contact member to remain in contact with the ground (e.g., as compared to support structures that do not include such flexibility and independently and relatively movable regions).

2. Foot Support Structures Including Various Traction Member Sets

Additional aspects of this invention relate to foot-supporting members (e.g., sole structures) for foot-receiving devices (e.g., articles of footwear, including athletic footwear) that include various traction member sets (e.g., sets of spikes, cleats, or other traction elements provided on a ground surface-contacting member or outsole member). Such foot-supporting members may include: (a) a contact surface-contacting member (e.g., an outsole member) including a forefoot portion, a heel portion, a lateral side, and a medial side; (b) a first set of traction members in the forefoot portion, the first set of traction members configured to inhibit forefoot movement in a lateral direction while optionally allowing forefoot movement in a medial direction; and (c) a second set of traction members in a heel portion, the second set of traction members configured to inhibit heel movement in the medial direction while optionally allowing heel movement in the lateral direction. Such traction member sets may be included in foot-supporting members having one or more lines of flex and/or recessed elements of the types described above.

Traction member sets of the types described above can be particularly useful for certain activities, for example, activities in which traction during a twisting action is needed (e.g., such as during golf swings, baseball or softball swings, lacrosse, field hockey, etc.). Traction member sets according to at least some examples of this invention may provide ample support for wearers when applying a twisting force, e.g., twisting about an axis running through the foot or leg during a swinging action. The traction elements in the forefoot portion may be constructed to prevent or inhibit movement of the forefoot in the lateral direction, and the traction elements in the heel portion may be constructed to prevent or inhibit movement of the heel in the medial direction. As a more specific example, movement of the forefoot in the lateral direction may be prevented or inhibited by providing one or more surfaces substantially perpendicular to the major surface of the contact surface-contacting member with an exposed face of this substantially perpendicular surface facing in the lateral direction. If desired, the traction element(s) may be tapered, rounded, or otherwise smoothly extend away from the exposed face back toward the medial side and/or toward the base level of the contact surface-contacting member. Likewise, movement of the heel in the medial direction may be prevented or inhibited by providing one or more surfaces substantially perpendicular to the major surface with an exposed face of this substantially perpendicular surface facing in the medial direction. If desired, the traction element (s) may be tapered, rounded, or otherwise smoothly extend away from the exposed face back toward the lateral side and/or toward the base level of the contact surface-contacting member. The term "substantially perpendicular," as used herein in this context and unless otherwise noted, includes perpendicular to the major surface or base level of the contact surface-contacting member ±15°. In some examples, the exposed faces will be perpendicular to the major surface of the contact surface-contacting member ±10° or even ±5° or less. In at least some examples, at least some of the traction elements may be designed such that at least one of their base dimensions (e.g., length or width along the base level) is greater than the traction elements height dimension (e.g., the distance it extends away from the base level). Such traction elements provide good support, ground-penetration, and/or ground-engagement properties to resist torque, e.g., during a golf swing (e.g., during a downswing motion), while still promoting easy disengagement from the ground for walking or other activities.

Also, as noted above, in at least some examples, the first set of traction members (in the forefoot portion) may be constructed to allow forefoot movement in the medial direction and the second set of traction members (in a heel portion) may be constructed to allow heel movement in the lateral direction. Such structures provide excellent resistance to or support for performing the twisting motion while still allowing easy movement of the foot at other times, e.g., after the twisting motion has been completed, during normal walking, running, or other ambulatory activities, etc.

If desired, some or all of the features of this aspect of the invention (i.e., the support structures with traction member sets) may be used in combination with some or all of the flexible support member aspects of the invention described above.

3. Foot-Receiving Device Products Including Support Structures According to the Invention Additional aspects of this invention relate to foot-receiving device products, such as articles of footwear, that include foot-supporting members, e.g., sole structures of the various types described above. In some examples according to the invention, the foot-receiving device products may include: (a) a foot-covering member; and (b) a foot-supporting member engaged with the foot-covering member. Foot-supporting members in accordance with this aspect of the invention may include one or more features and aspects of the flexible contact surface-contacting members and/or the traction member sets described above, including any desired subsets and/or combinations of these features and aspects. Additional structures and features may be included in such foot-receiving device products without departing from the invention, including the various additional structures and features described above, as well as conventional structures and features that are known and used in the art, such as midsole structures, innersole board structures, insole structures, sock liners, heel impact-attenuating elements, closure systems, heel counters, etc.

Specific examples and structures according to the invention are described in more detail below. The reader should understand that these specific examples and structures are set forth merely to illustrate the invention, and they should not be construed as limiting the invention.

D. Specific Examples of the Invention

The various figures in this application illustrate examples of foot support members and their arrangement in foot-receiving device products according to some examples of this invention. When the same reference number appears in more than one drawing, that reference number is used consistently in this specification and the drawings to refer to the same or similar parts throughout.

FIGS. 1A through 1H illustrate various views of an example sole structure 100 (e.g., including an outsole member) according to at least some examples of this invention. The sole structure 100 of this illustrated example includes a first major surface forming an exterior, ground (or other surface) contacting member 102 and an interior major surface 104 opposite the ground-contacting member surface 102. The ground-contacting member surface 102 includes a base level 106, which, in this illustrated example, forms a generally continuous base for various features of the sole structures 100, which will be described in more detail below. The base level 106 may be relatively flat, smoothly sloped or curved (e.g., to include various conventional shoe features, like a forefoot region, an arch region, a heel region, a toe region, etc.), or otherwise shaped, without departing from this invention. The base level 106 (as well as the remainder of the sole structure 100) may be made of any desired materials without departing from this invention, including, for example, leather, synthetic rubbers, polymers (e.g., thermoplastic polyurethanes), and the like. The base level 106 also may be constructed from multiple independent and/or unconnected pieces and/or it may correspond to only a portion of the overall sole structure 100 (e.g., only the forefoot portion, excluding the toe portion, excluding the rear heel portion, etc.) without departing from this invention.

The base level 106 of this illustrated example includes a plurality of generally longitudinally arranged recessed segments (e.g., segments 108*a*, 108*b*, and 108*c*, generally and generically referred to as segments 108) defined therein and a plurality of generally laterally arranged recessed segments (e.g., segments 110*a*, 110*b*, 110*c*, 110*d*, 110*e*, and 110*f*, generally and generically referred to as segments 110) defined therein. The recessed segments 108 and 110 may be provided in the sole structure 100 in any desired manner, such as during a sole member molding process, by a cutting action (e.g., using knives, lasers, etc.), and/or in any other manner, including in conventional manners known and used in the art. The recessed segments 108 and 110 in this illustrated example structure 100 provide lines of flex in the sole structure 100 and divide the sole structure 100 into various regions, such as a forefoot lateral region, a forefoot central region, a forefoot medial region, a heel lateral region, and a heel medial region. Additionally, in this example structure 100, the recessed segments 108 and 110 provide thinned areas of the sole structure 100 such that at least some of the various regions (e.g., the forefoot lateral region, the forefoot central region, and the forefoot medial region) are movable or rotatable about the lines of flex with respect to one another to allow the various regions to independently engage and disengage from a contact surface as a dynamic force moves laterally across the interior surface 104.

For example, during a golf swing (or other swinging action), a golfer may shift his or her weight laterally from the central area of the foot toward a lateral or medial side of the foot, and from there back toward the center and possibly past center and toward the other side. As the weight shifts, the sole of a golfer's shoe may tend to lose contact with the ground, particularly when the golfer wears a shoe having a conventional, relatively stiff or inflexible sole structure. By providing lines of flex and the longitudinal recessed segments 108, the sole structure 100 can flex with the golfer's foot in the interior of the shoe about the lines of flex defined by the recessed segments 108 and thereby maintain a larger percentage of the sole structure 100 in contact with the ground or other contact surface during the course of the swing (or other activity). Additionally, during a golf swing (or while walking or during other activities), a golfer may shift his or her weight from the central area of the foot toward a front or rear of the foot, and from there back toward the center and possibly past center and toward the opposite end. As the weight shifts, the sole of a golfer's shoe may tend to lose contact with the ground, particularly when the golfer wears a shoe having a conventional, relatively stiff or inflexible outsole structure. By providing lines of flex and the lateral recessed segments 110, the sole structure 100 can flex with the golfer's foot in the interior of the shoe about the lines of flex defined by the recessed segments 110 and thereby maintain a larger percentage of the sole structure 100 in contact with the ground or other contact surface during the course of the swing, step, or other activity.

While referred to as extending in the "longitudinal direction," the recessed segments 108 need not extend exclusively in a direction of a longitudinal center line of the sole structure 100. Rather, as shown in the figures, the term "longitudinal direction," as used herein in this context, means that the recessed segments 108 and the corresponding lines of flex defined thereby extend predominantly in the longitudinal direction (e.g., generally from the shoe's front toward its back), optionally in a curved manner (e.g., to correspond to a typical foot's lines of flex and/or flexibility in the longitudinal direction). Additionally, as shown, no individual longitudinal recessed segment 108 or line of flex need extend completely from the sole structure 100 front to its back. When multiple longitudinally extending recessed segments 108 are present (e.g., segments 108*a*, 108*b*, and 108*c*), the various segments need not be parallel to one another and they need not extend in precisely the same directions or in the same arch or curvature, as shown for example in FIG. 1A. Optionally, if desired, the lines of flex in the sole structure 100 may correspond to typical areas of flex in a wearer's foot. As shown in FIG. 1A, the lines of flex and the recessed segments 108 also may be somewhat arched or curved, particularly in the forefoot area, e.g., with recessed segments 108*a* and 108*b*.

Similarly, while referred to as extending in the "lateral direction," the recessed segments 110 need not extend exclusively in a direction of across the sole structure 100. Rather, as shown in the figures, the term "lateral direction," as used herein in this context, means that the recessed segments 110 and the corresponding lines of flex defined thereby extend predominantly in the lateral direction (e.g., generally from the shoe's lateral side toward its medial side), optionally in a curved manner (e.g., to correspond to a typical foot's lines of flex and/or flexibility in the lateral direction). Additionally, if desired, it is not necessary for individual lateral recessed segments 110 or lines of flex to extend completely across the sole structure 100. When multiple laterally extending recessed segments 110 are present (e.g., segments 110*a*, 110*b*, 110*c*, 110*d*, 110*e*, and 110*f*), the various segments need not be parallel to one another and they need not extend in precisely the same directions or in the same curvature, as shown for example in FIG. 1A. Optionally, if desired, the lines of flex in the sole structure 100 may correspond to typical areas of flex in a wearer's foot. Also, as shown in FIG. 1A, the lines of flex and the recessed segments 110 also may be somewhat arched or curved.

The recessed segments 108 and 110 may be any desired size (e.g., length, width, and/or depth) without departing from the invention. As some more specific examples, if desired, the recessed segments may be about 1 mm to 10 mm wide and 1 mm to 10 mm deep. In some more specific examples, the recessed segments may be about 1-5 mm wide and 1-5 mm deep. Optionally, in at least some examples, the recessed segments 108 and/or 110 may be of sufficient depth to leave a thickness of 0.25-8 mm, and in some instances 1-5 mm, of base material at the bottom of the recessed segment 108 and/or 110. Of course, not all of the recessed segments in a given shoe need have the same dimensional characteristics. Additionally, the dimensions of recessed segment(s) 108 and/or 110 may vary along the length, width, and/or depth of an individual segment.

If desired, some or all of the recessed segments 108 and/or 110 may be at least partially filled with another material 112 (e.g., to help prevent undesired penetration of the sole structure 100 at areas having reduced or thinned amounts of base material, to reduce wearer feel of external elements at these areas having reduced amounts of base material, etc.). As shown in the figures, in this illustrated example, the material 112, which may be somewhat softer than the material making up the base layer 106, partially fills the recessed segments 108 and/or 110, leaving a small gap at the sides of each recessed segment 108 and 110 (e.g., the fill material 112 may be centered or otherwise positioned within the recessed segments 108 and/or 110 to leave a gap along each side) and/or a recess or slight step down in the depth direction. This gap can be useful, in at least some structures, to allow the desired flexibility characteristics identified above while still leaving the recessed segments 108 and/or 110 substantially filled to prevent the undesired penetration and feel-through characteristics also identified above. Any desired gap size (including no gap) and/or thickness of fill material 112 may be provided without departing from this invention. The fill material 112 may be provided in the recessed segments 108 and/or 110 in any desired manner without departing from the invention, such as by molding, by cements or adhesives, etc., including in conventional manners known and used in the art.

As noted above, the fill material 112, when present, may be somewhat softer than the material making up the base layer 106. Of course, any desired types of materials may be used for these structures, including rubber or polymeric materials (such as thermoplastic polyurethanes), including materials that are known and conventionally used in the art. As some more specific examples, the base layer 106 material may be constructed from a rubber material, e.g., having a hardness of 60 to 75 Shore A (and in some examples, 64 to 70 Shore A), and the fill material 112 may have about the same level of hardness, or perhaps a bit softer (optionally made from rubber or a thermoplastic polyurethane material). As additional potential examples, if desired, the fill material 112 may be a thermoplastic polyurethane (TPU) material having a hardness in the range of 64 to 80 Shore A (e.g., in some examples, approximately 70 to 78 Shore A or even about 75 Shore A), while the base layer 106 also may be a thermoplastic polyurethane (TPU) material having a higher hardness than the fill material 112, for example, in the range of 70 to 90 Shore A (e.g., in some examples, in the range of 75 to 88 Shore A or even 80 to 85 Shore A). Moreover, the entire base layer 106 need not have the same hardness. For example, if desired, the medial side may be made of a harder material than the lateral side or vice versa (e.g., 80 Shore A hardness for the lateral side and 85 Shore A hardness for the medial side, in one example). Of course, a wide variety of other materials and/or combinations of materials and/or hardnesses may be used without departing from the invention.

The lines of flex and/or recessed segments 108 and/or 110 need not be located in both the forefoot and the heel sections of an article of footwear in all examples of the invention. Rather, if desired, one or more lines of flex and/or recessed segments 108 and/or 110 may be provided in any one or more of the heel area, the arch area, and/or the forefoot areas without departing from the invention.

Figure 1B:
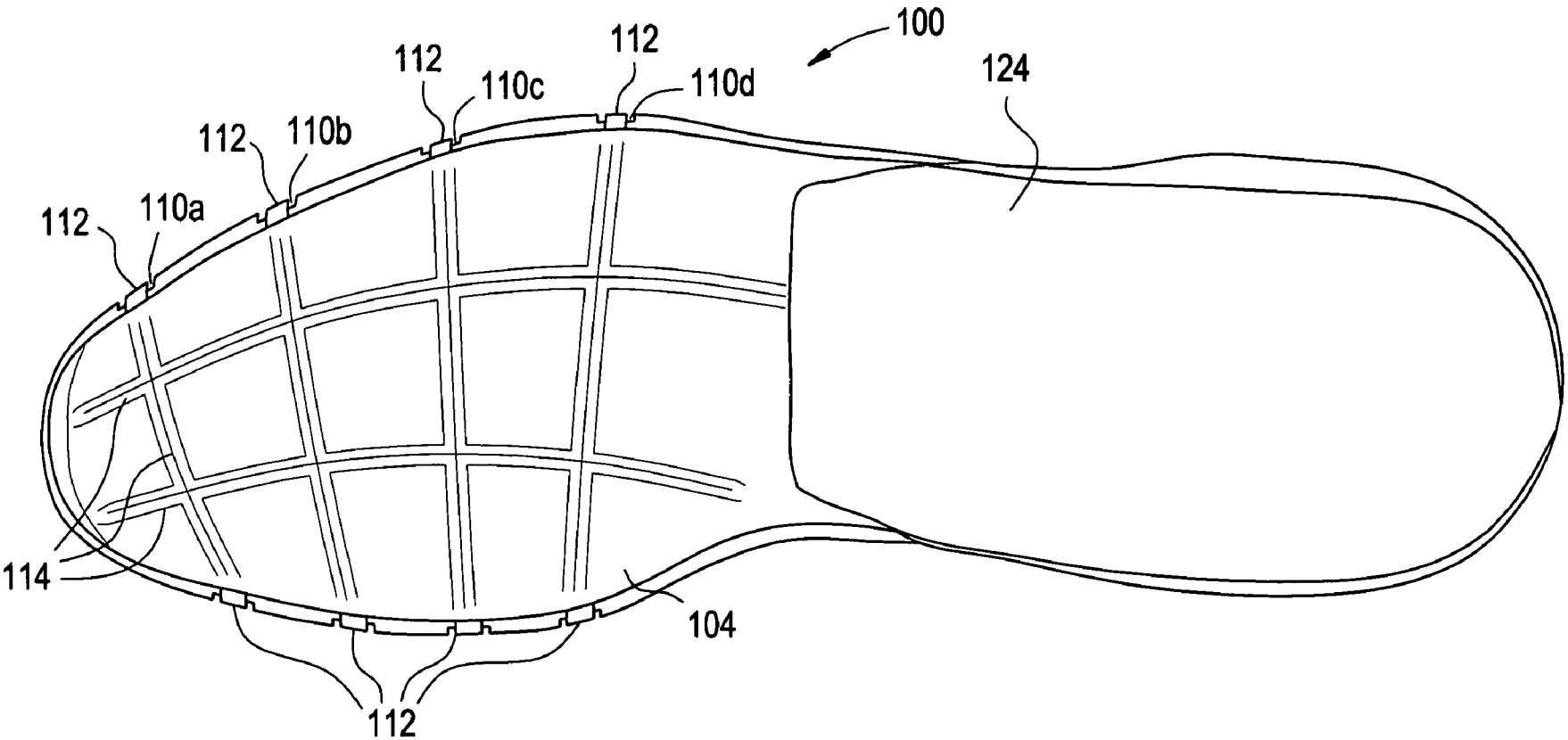
FIG. 1B illustrates a top (interior) plan view of a sole structure according to at least some examples of this invention.
Figure 1C:
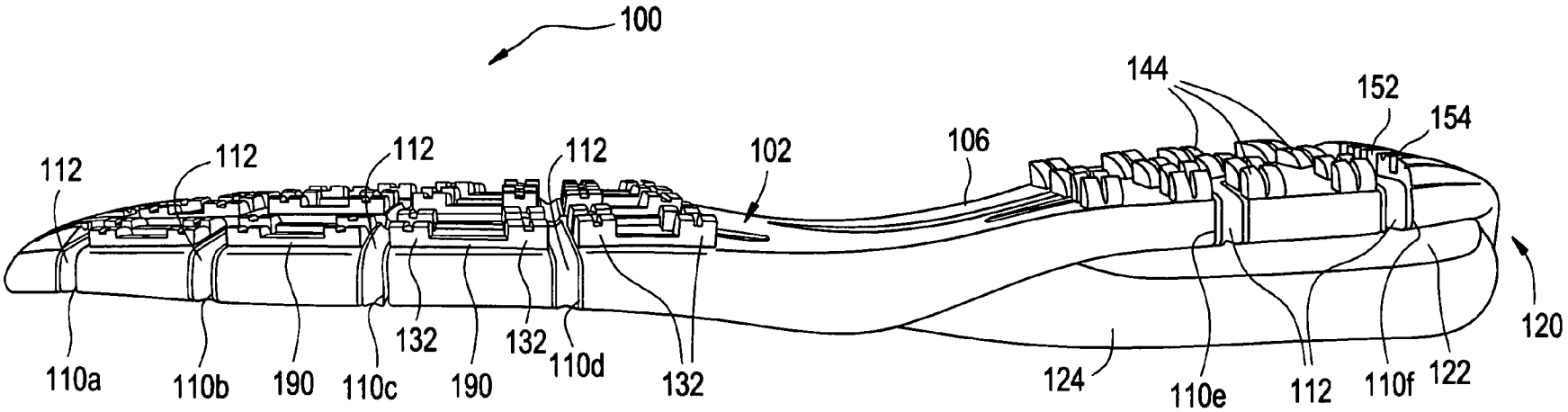
FIG. 1C illustrates a lateral side view of a sole structure according to at least some examples of this invention.
Figure 1D:
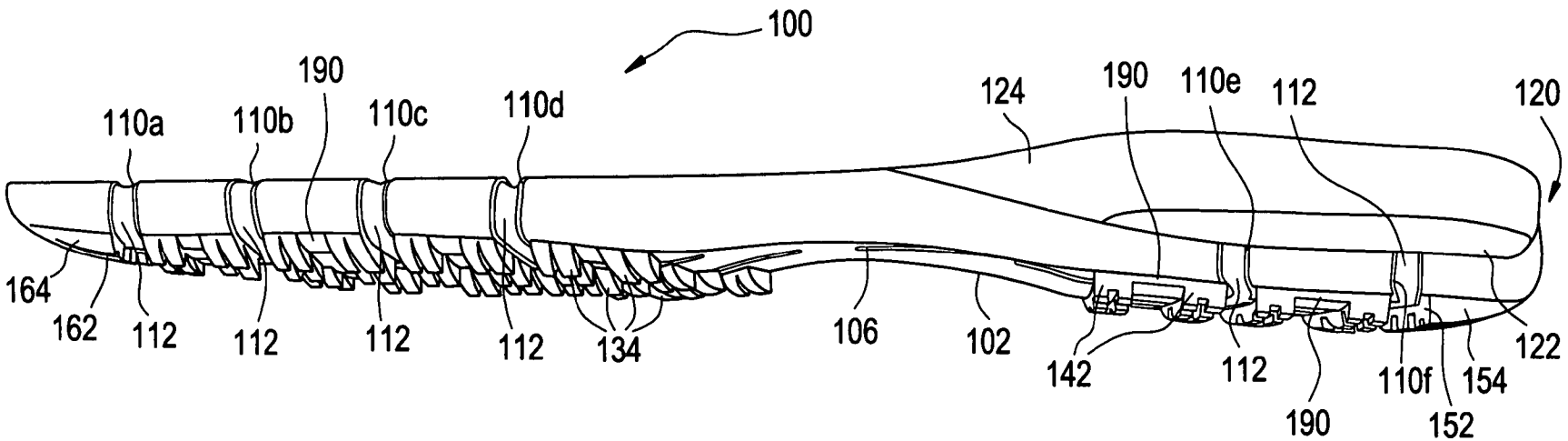
FIG. 1D illustrates a medial side view of a sole structure according to at least some examples of this invention.
Figure 1E:
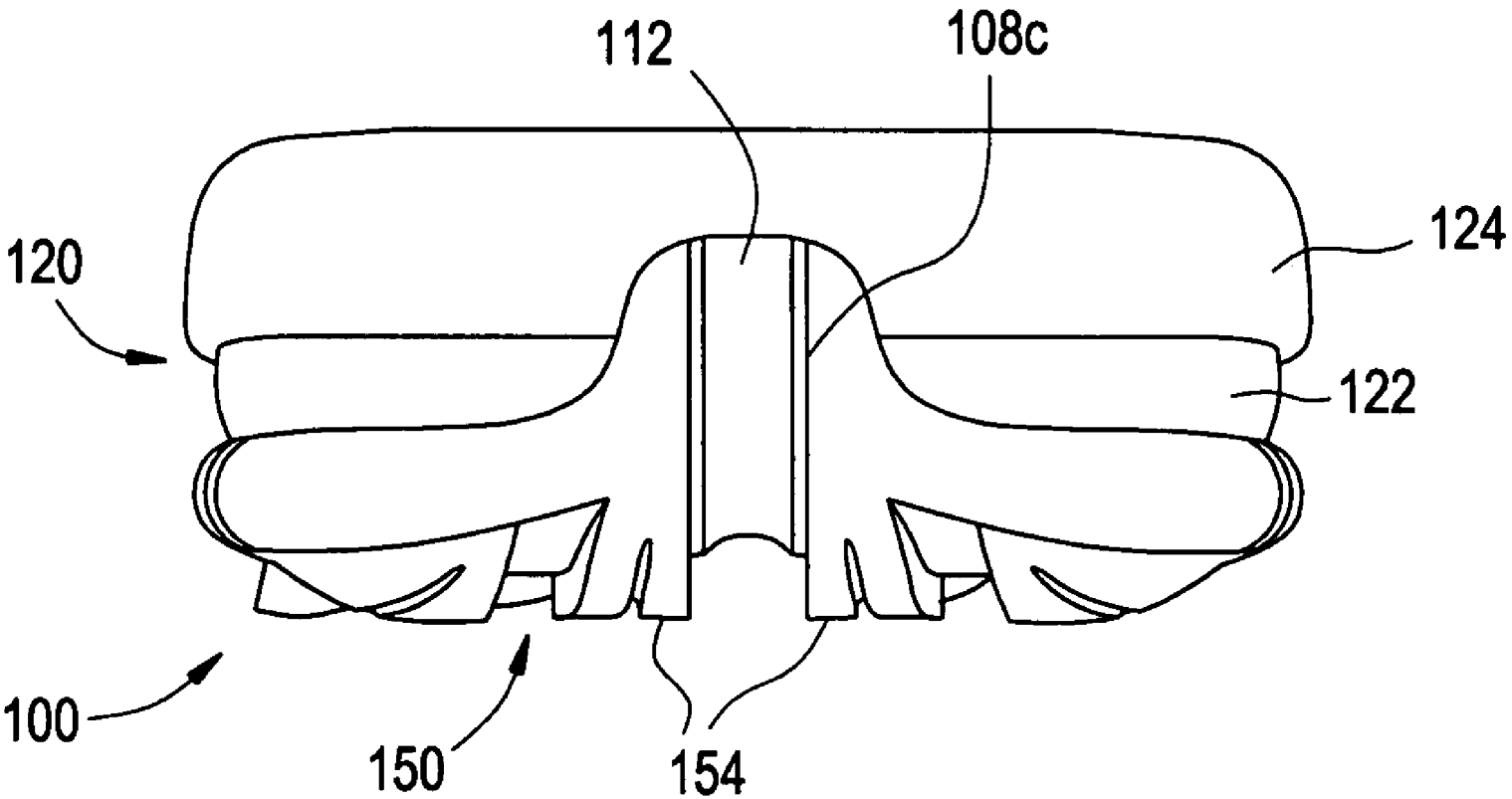
FIG. 1E illustrates a rear view of a sole structure according to at least some examples of this invention.
Figure 1F:
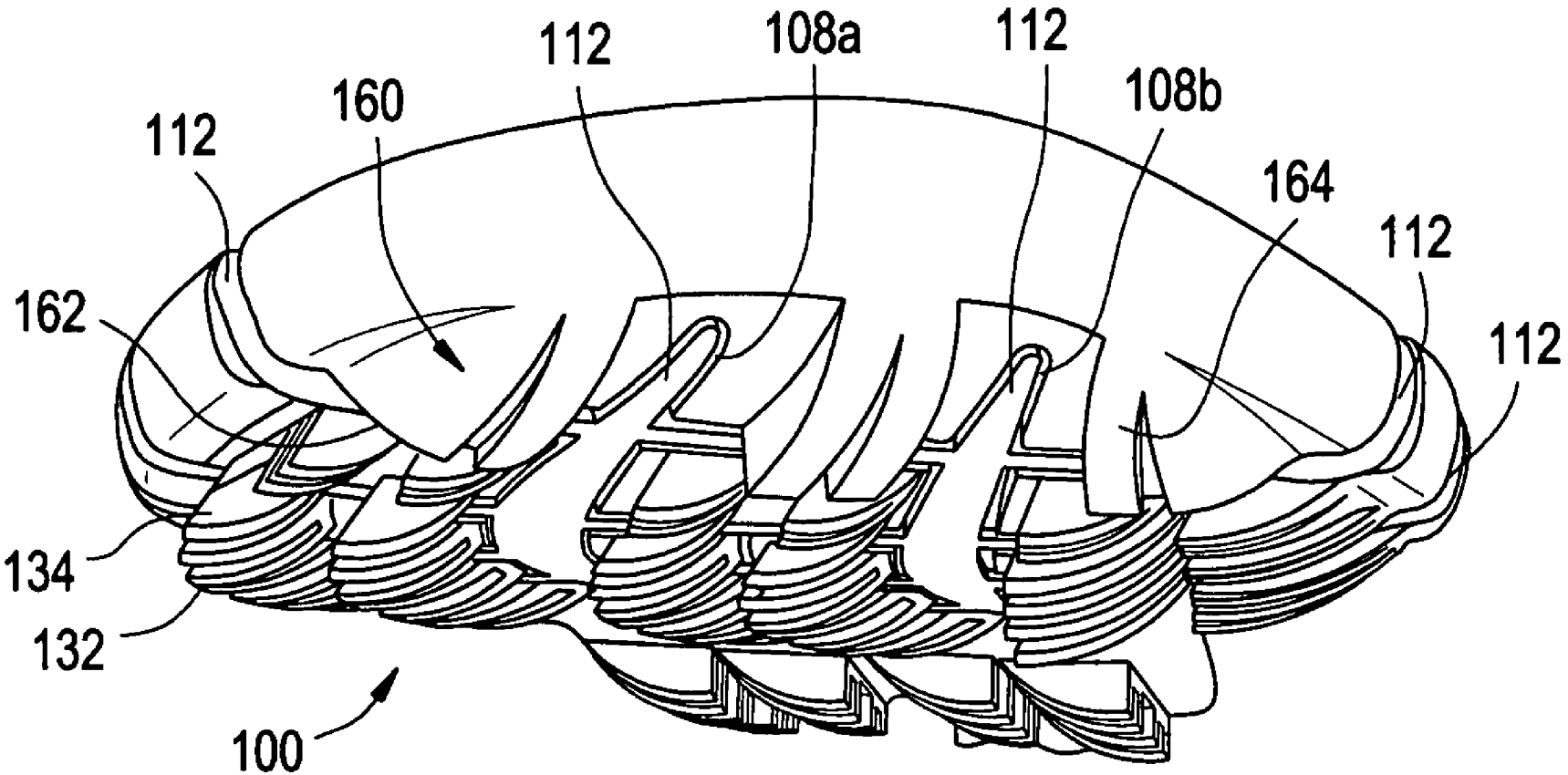
FIG. 1F illustrates a front view of a sole structure according to at least some examples of this invention.
Figure 1G:
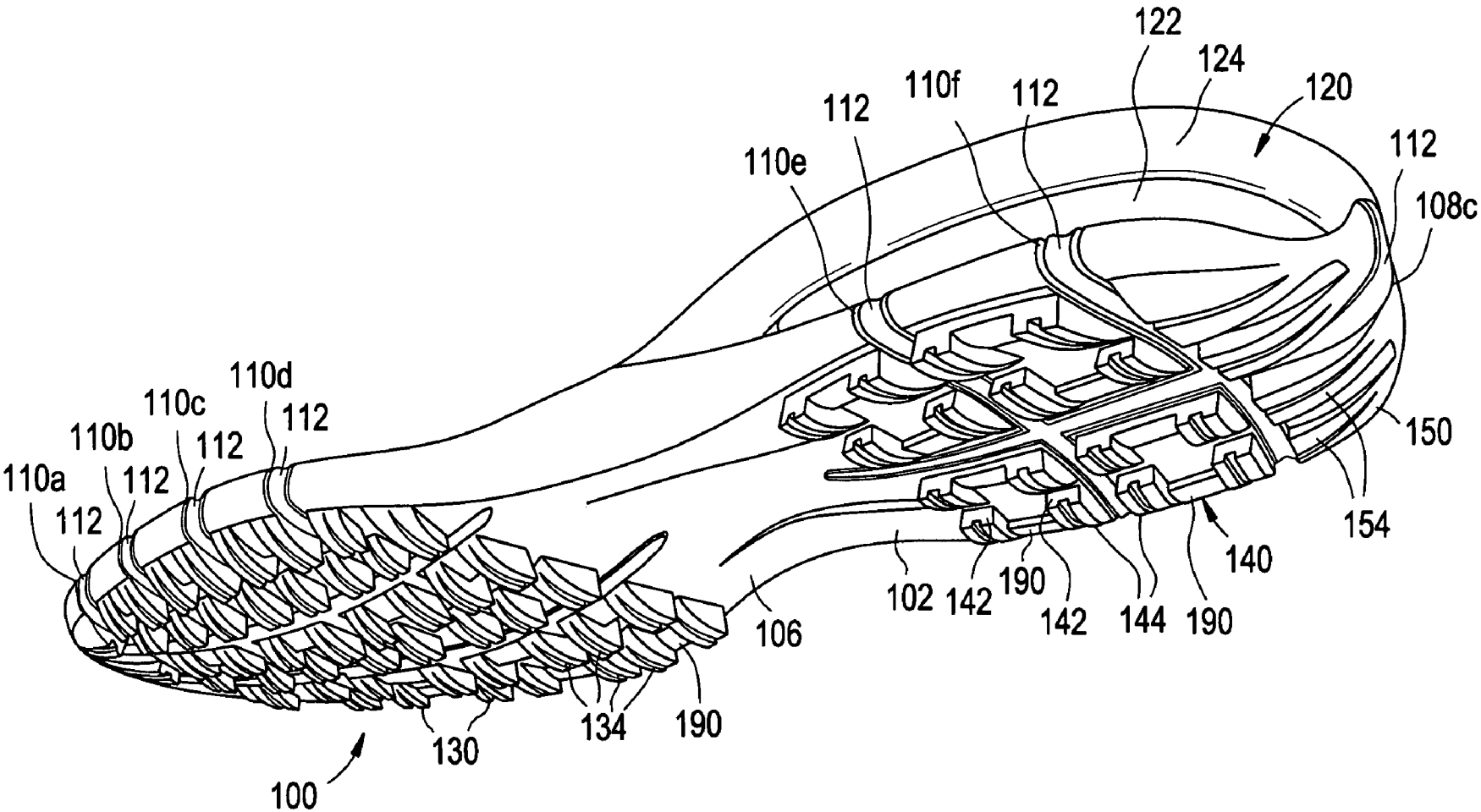
FIG. 1G illustrates a medial perspective view of a sole structure according to at least some examples of this invention.
Figure 1H:
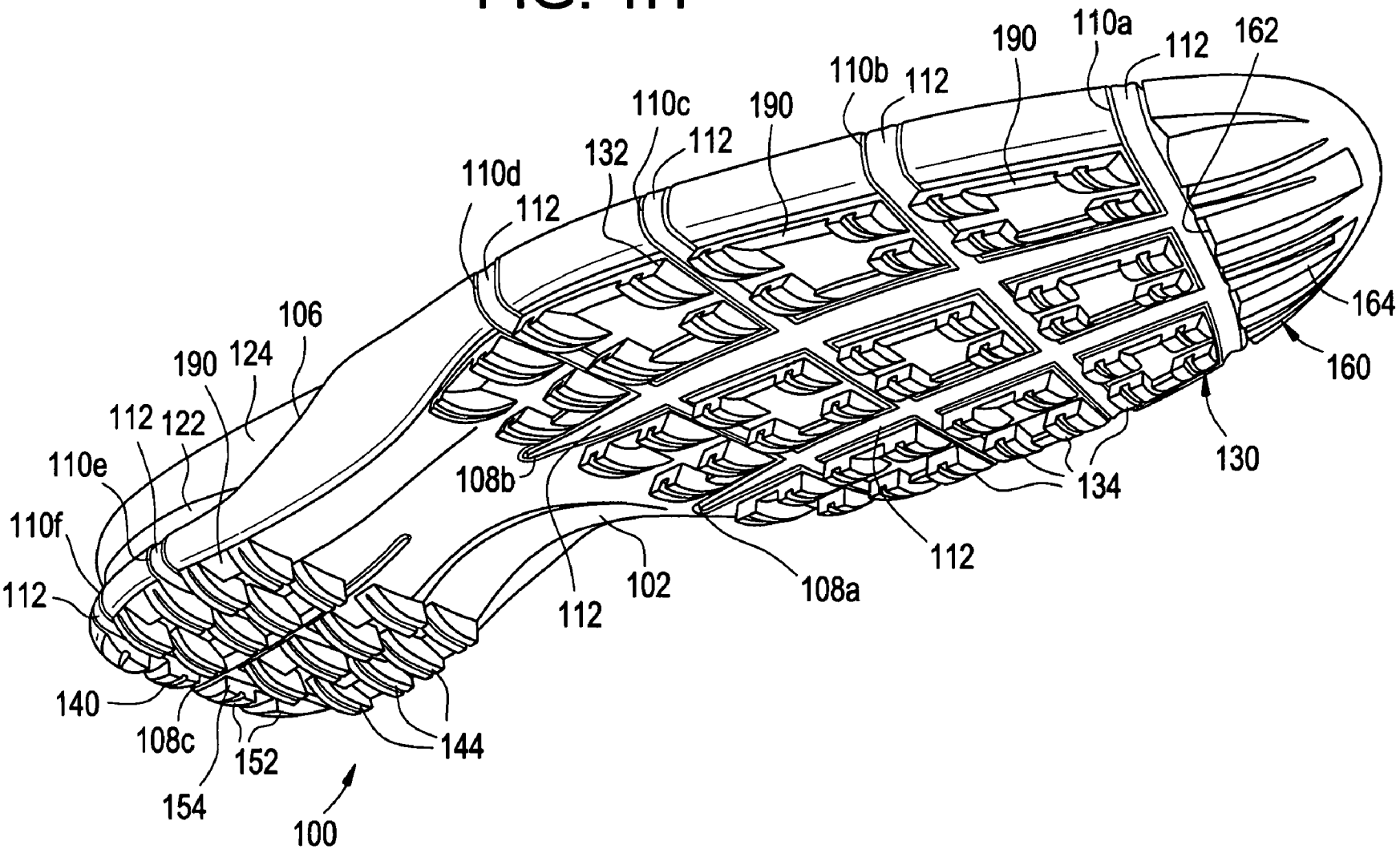
FIG. 1H illustrates a lateral perspective view of a sole structure according to at least some examples of this invention.

FIG. 1B shows a plan view of the interior surface 104 of the sole structure 100 according to this example. As shown, the interior surface 104 includes lines of flex 114 formed therein corresponding to the locations of the recessed segments 108 and 110 on the opposite forefoot surface 102 of the sole structure. These interior lines of flex 114 can help further promote the desired flexibility characteristics of the overall sole structure 100, as described above.

The figures illustrate other structural features of sole structures that may be present in at least some examples of this invention. For example, the figures illustrate that this example sole structure 100 includes an impact-attenuating heel unit 120 that provides additional impact-attenuation characteristics for the heel area of the shoe. By providing a separate impact-attenuating heel unit 120 in this example, the outsole portion of the sole structure 100 may be maintained relatively thin (e.g., 1 to 20 mm at the base layer 106 (in some examples 1.5 to 5 mm or even 2-3 mm) and 0.25 to 8 mm at the recessed portions 108 and 110 (in some examples 0.25 to 2 mm or even 0.5 to 1.5 mm)), to help preserve flexibility, while still providing adequate impact-attenuation for a comfortable walk or other activities. While any desired type of impact-attenuating heel unit 120 may be provided without departing from this invention, in this illustrated example structure 100, the heel unit 120 includes a gas-filled bladder element 122 at least partially held by or enclosed in an impact-attenuating polymeric material 124, such as a polyurethane or ethylvinylacetate material. Also, while any desired size or thickness of heel unit 120 may be provided, in this illustrated example, the overall heel unit 120 is approximately 15 mm thick at its central, heel supporting location. Gas-filled bladders 122 and/or impact-attenuating materials 124 of this type are known and used in conventional footwear products, such as in various AIR® brand footwear products available from NIKE, Inc. of Beaverton, Oreg.

Of course, if desired, other types of heel units or other impact-attenuating elements or structures may be provided without departing from the invention, such as conventional foam or other impact-attenuating materials, columnar shock absorbing type elements (such as those commercially available in various SHOX® brand footwear products available from NIKE, Inc. of Beaverton, Oreg.), and the like. Also, if desired, the gas-filled bladder 122, shock absorbing element, or other impact-attenuating elements, when present, may be hidden within another material (such as in impact-attenuating material 124), partially hidden in such a material, or open and exposed to the external environment, without departing from this invention.

Sole structures according to the invention may have additional structural features that enhance their ability to provide traction, e.g., during twisting actions such as those used in golf, baseball, or softball swings; during standing, swinging, walking, running or other activities, particularly on uneven terrain; etc. Of course, any desired type of traction elements may be provided without departing from the invention, including conventional traction elements as are known and used in the art.

Sole structures 100 according to at least some examples of the invention, however, may include traction elements that assist in the various swinging and other activities and actions described above. In this illustrated example sole structure 100, the bottom surface 102 of the sole structure 100 includes plural traction elements that assist in performing a variety of different functions. For example, plural traction elements 130 in the forefoot area include a substantially perpendicular wall 132 facing the lateral side direction and a sloped wall 134 extending back from the wall 132 to the base level 106. In this manner, the traction elements 130 provide a strong base and support to inhibit or prevent movement of the forefoot portion of the foot in the lateral direction (e.g., to provide a strong base and support during a golf downswing) while allowing relatively easy forefoot movement in the medial direction (e.g., to allow easy movement of the foot again when walking resumes, etc.).

The example sole structures 100 illustrated in FIGS. 1A through 1H provide a different type or orientation of traction elements 140 in the heel portion. More specifically, in this illustrated example sole structure 100, the traction elements 140 in the heel area include a substantially perpendicular wall 142 facing the medial side direction and a sloped wall 144 extending back from the wall 142 to the base level 106. In this manner, the traction elements 140 provide a strong base and support to inhibit or prevent movement of the heel portion of the foot in the medial direction (e.g., to provide a strong base and support during a golf downswing) while allowing relatively easy heel movement in the lateral direction (e.g., to allow easy movement of the foot again when disengaging from the ground, when walking resumes, etc.).

Still a different traction element 150 structure or orientation is provided in the rear heel area of the sole structure 100 illustrated in FIGS. 1A through 1H. As shown, in this example structure 100, the heel area includes traction elements 150 having a substantially perpendicular wall 152 facing the footwear front with a sloped wall 154 extending back from the front wall 152. This structure and orientation helps provide traction when walking, standing, or swinging (or performing other activities) particularly on a downhill or downward slope. Additionally, another traction element 160 structure or orientation is provided in the very front toe area of the sole structure 100. As shown in this illustrated example structure 100, the toe area includes traction elements 160 having a substantially perpendicular wall 162 facing the footwear rear with a sloped wall 164 extending forward from the wall 162. This structure and orientation helps provide traction when walking, standing, or swinging (or performing other activities) particularly on an uphill or upward slope.

As noted above, any type or arrangement of traction elements may be used without departing from the invention. Such traction elements (e.g., elements 130, 140, 150, and/or 160) may be included as part of the sole structure 100 in any desired manner without departing from the invention, such as by integrally molding them into the sole structure 100 along with other portions of the sole structure 100 (such as the base level 106), by attaching them to the sole structure 100 (e.g., to the base level 106 by adhesives, cements, screws, clasps, retaining elements, other mechanical connectors, etc.), etc. In the illustrated example sole structure 100, at least some of the traction elements (e.g., elements 130, 140, 150, and/or 160) are designed such that at least one of their base dimensions (e.g., length or width along the base level 106) is greater than the traction element's height dimension (e.g., the distance it extends away from the base level 106). Such traction elements provide good support, ground-penetration, and/or ground-engagement properties to resist torque during a golf swing (e.g., during a downswing motion), while still allowing for easy disengagement from the ground, e.g., for walking or other activities. If desired, according to at least some examples of this invention, traction elements of the types and/or in the arrangements shown in U.S. Pat. Nos. 6,817,117 and/or 6,705,027 may be used without departing from this invention. Each of these U.S. Patents is entirely incorporated herein by reference.

As shown, for example, in FIG. 1A, the various recessed segments 108 and 110 divide the outsole member bottom surface 102 into a plurality of different regions, such as a toe region, a lateral forefoot region, a central forefoot region, a medial forefoot region, a rear region, a medial heel region, and a lateral heel region. These various different regions also may be divided into smaller regions, e.g., due to the presence of the lateral recessed segments 110. In this illustrated example structure 100, the following sections and sub-sections of traction elements are included: (a) the toe region includes three sections (lateral, medial, and central) with a single, separate traction element provided in each section; (b) the forefoot region includes twelve total sections (e.g., lateral, central, and medial forefoot sections, each section containing four separate sub-sections of traction elements, and each sub-section itself containing plural individual traction elements); (c) the heel region includes four total sections (e.g., lateral and medial heel sections, each section containing two separate sub-sections of traction elements, and each sub-section itself containing plural individual traction elements); and (d) the heel region includes two sections (medial and lateral) with plural traction elements in each section. Of course, while many of the individual sections and sub-sections described above include multiple individual traction elements, these individual sections and sub-sections may include any desired number of traction elements without departing from this invention.

If desired, as illustrated in FIGS. 1A, 1C, 1D, 1G, and 1H, various traction elements, e.g., at least some located within a given sub-region, may be connected to one another in various ways. For example, as shown in these figures, the bases of adjacent traction elements within a given sub-region (e.g., between recessed segments 110*c* and 110*d*) are joined together by a base element 190 extending between the front walls of the traction elements and along at least a portion of their sloped walls. Also, if desired, the front wall of one traction element (e.g., front wall 132) generally may come very close to or abut against the adjacent sloped wall of another traction element within the same sub-region (e.g., sloped wall 134). This base element connection 190, contact, and/or close structural arrangement of traction elements can help provide and/or maintain a firmer, more stable feel during a golf swing or other activities when utilizing the traction elements, e.g., one traction elements is tied to other traction elements by a base member or contact to provide added levels of support.

As illustrated in the figures, in at least some example structures according to this invention, if desired, the resulting sole may be "spikeless," e.g., not including detachable metal or plastic cleat elements.

Figure 2:
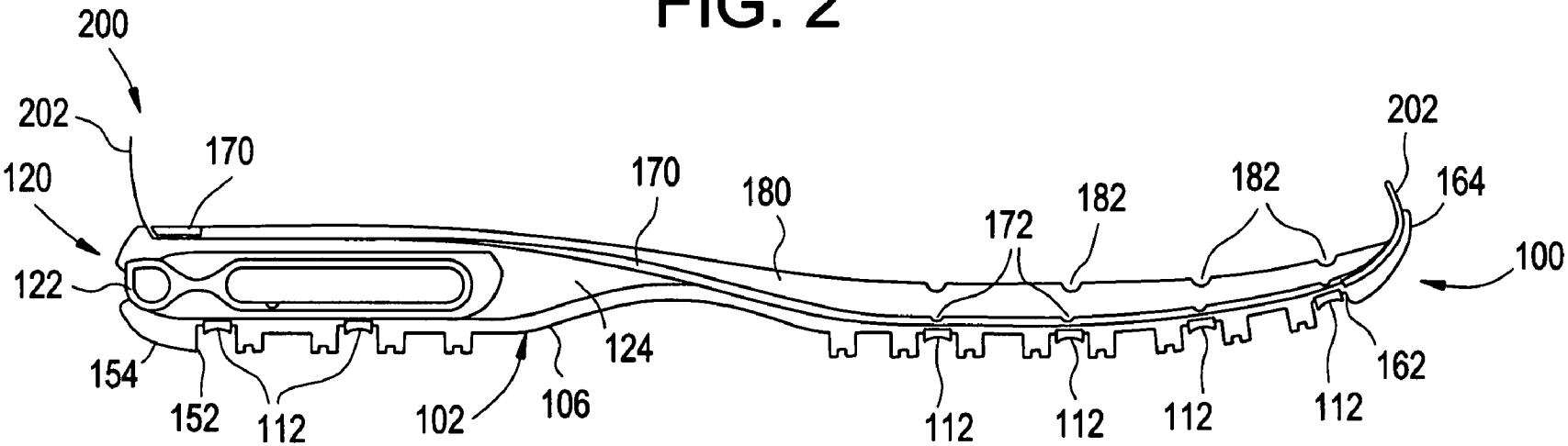
FIG. 2 illustrates a partial side view of an example article of footwear including a sole structure according to at least some examples of this invention.
Figure 2B:
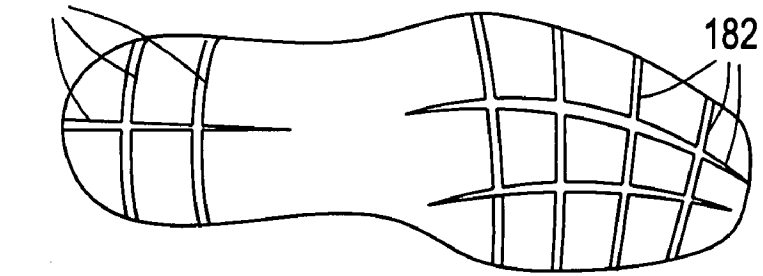
FIG. 2B illustrates a top plan view of an example midsole structure that may be included in an article of footwear according to at least some examples of this invention.
Figure 2A:
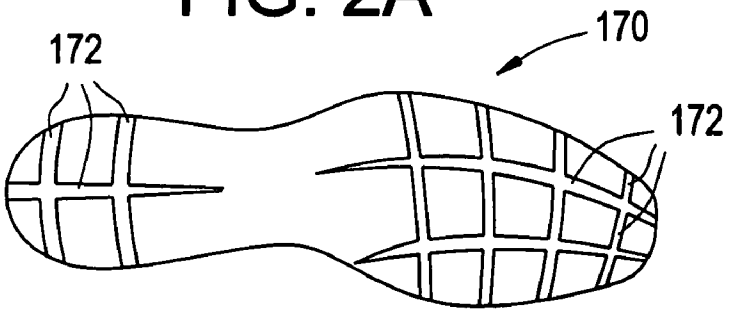
FIG. 2A illustrates a top plan view of an example innersole board structure that may be included in an article of footwear according to at least some examples of this invention.

FIG. 2 illustrates a partial side view of an example article of footwear 200 that may include a sole structure 100 in accordance with at least some examples of this invention. The sole structure 100 of this example further includes an innersole board element 170 (see also FIG. 2A) engaged with the interior surface 104 and/or the impact-attenuating member 124 of the sole structure 100. If desired, as shown in FIGS. 2 and 2A, at least the uppermost surface of the innersole board element 170 (e.g., the surface nearest the wearer's foot) also may include lines of flex 172 (e.g., thinned regions, pre-bent, bendable, or kinked regions, open areas or discontinuities, etc.), optionally positioned to correspond to some or all of the lines of flex and recessed regions 108 and 110 of the outsole member's ground-contacting surface 102. If desired, the lower surface of the innersole board element 170 also may include lines of flex. The innersole board 170 may provide additional support, and it may be made from any desired material, such as metals, polymeric materials (e.g., PEBAX® (a polyether-block co-polyamide polymer available from Atofina Corporation of Puteaux, France), etc.), and the like, and of any desired thickness and/or varying thicknesses (e.g., 0.25 mm to 5 mm) without departing from this invention.

In at least some example sole structures 100 according to the invention, the sole structure 100 further may include a midsole or other impact-attenuating element 180 (see also FIG. 2B) engaged with the innersole board 170, the interior surface 104 of the sole structure 100, and/or the impact-attenuating member 124 of the sole structure 100. If desired, as shown in FIGS. 2 and 2B, at least the uppermost surface of the midsole element 180 (e.g., the surface nearest the wearer's foot) also may include lines of flex 182 (e.g., thinned regions, pre-bent, bendable, or kinked regions, open areas or discontinuities, etc.), optionally positioned to correspond to some or all of the lines of flex and recessed regions 108 and 110 of the outsole member's ground-contacting surface 102. If desired, the lower surface of the midsole element 180 also may include lines of flex. The midsole element 180 may provide additional impact-attenuating characteristics, and it may be made from any desired material, such as rubber, polymeric materials (e.g., polyurethane, ethylvinylacetate, phylon, phylite, foams, etc.), and the like, and of any desired thickness and/or of varying thicknesses (e.g., 0.5 mm to 10 mm, and in some examples about 3-8 mm or even 5-6 mm) without departing from this invention.

The footwear structure 200 of this example further includes an upper member 202 engaged with the sole structure 100. Any desired manner of engaging (directly or indirectly) the upper member 202 and the sole structure 100 with one another may be used without departing from the invention, including conventional ways known and used in the art. As a more specific example, as illustrated in FIG. 2, the upper member 202 may be engaged and held between the innersole board 170 and the outsole member 100 and/or between the midsole element 180 and the outsole member 100, e.g., in conventional lasting procedures and/or the like, e.g., using cements, adhesives, stitching, or the like. The upper member 202 may be made of any desired materials and/or combinations of materials without departing from the invention, including conventional materials known and used in the art, such as one or more of fabrics, leathers, polymeric materials, rubber materials, etc.

The upper member 202 may contain any desired number of pieces and/or may be made in any desired construction without departing from the invention, including in conventional constructions known and used in the art. The footwear structure 200 also may include additional structures or elements, including conventional structures and/or elements known and used in the art, such as securing systems (e.g., laces, buckles, hook-and-loop fasteners, zippers, etc.); heel counters; insole members; interior booties; sock liners; additional impact-attenuating elements; gas-filled bladders; impact-attenuating foam or other columns; etc.

In use, aspects and features of this invention can help wearers maintain a high level and degree of surface area contact with the ground in a variety of different situations, such as when making a swinging action, when stepping or otherwise moving (even on hilly or uneven terrain), and/or at other times when a wearer shifts his/her weight and/or changes his/her center of gravity while wearing the article of footwear 200. For example, when standing still on level ground (e.g., at the start of a golf swing), a wearer's weight may be relatively evenly distributed over his/her feet (e.g., on the center or balls of the feet). As the wearer begins a golf swing (or other swinging action), he/she may begin to shift his/her weight to the sides and/or front of the foot (toward the medial side for the front foot and toward the lateral side for the rear foot during a golf swing). As the center of gravity or weight shifts across the interior of the sole structure 100, the individual sections and/or sub-sections of the sole member 100 may move (e.g., rotate or move somewhat with respect to one another about the lines of flex 108 and/or 110) such that the entire sole member 100 does not lose contact with the ground at one time and/or at an early time in the overall swing process.

More specifically, as noted above, during the beginning portion of a golf swing (the backswing), the player's weight may shift toward the medial side of the front foot and toward the lateral side of the rear foot. Because the front portion of the front foot's sole structure 100 can move about the recessed segment 108*b* as the weight shifts toward the medial side of the front foot, the lateral-most portion of the sole structure 100 can leave the ground if necessary (due to the flexibility of the sole structure 100 about recessed segment 108*b*) while the central and medial portions of the sole structure 100 maintain good contact with the ground. Similarly, for the rear foot, because the front portion of the rear foot's sole structure 100 can move about the recessed segment 108*a* as the weight shifts toward the lateral side of the rear foot, the medial-most portion of the sole structure 100 can leave the ground if necessary (due to the flexibility of the sole structure 100 about recessed segment 108*a*) while the central and lateral portions of the sole structure 100 maintain good contact with the ground. If necessary, as the backswing length and weight shift further increase, rotation of the front foot about recessed segment 108*a* can occur and rotation of the rear foot about recessed segment 108*b* can occur, such that the front foot can maintain more of its medial portion in contact with the ground and the rear foot can maintain more of its lateral portion in contact with the ground as compared with conventional sole structures. The heel portion of the foot also may be made to be movable or rotatable independently about recessed segment 108*c* as the wearer's weight shifts.

As the swing transitions from a backswing to a forward swing, the wearer's weight and/or center of gravity may shift in the shoes back toward the center and toward the shoes' opposite sides (e.g., in at least some swing sequences, a twisting force will be applied with its axis generally running through a central portion of the wearer's foot or leg). By providing the substantially perpendicular walls 132 facing the front lateral side of the wearer's foot and the substantially perpendicular walls 142 facing the rear medial side of the wearer's foot, a wearer can get good traction to support pushing off during the golf swing (e.g., the substantially perpendicular walls 132 and 142 can engage the ground and provide a relatively solid base for the swing). Additionally, movement of the various portions of the sole structure 100 about recessed segments 108*a*, 108*b*, and 108*c* (and/or 110) can help maintain more of the sole structure 100 in contact with the ground as the weight shift occurs during the downswing and follow-through actions.

The traction elements 160 on the front portion of the sole structure 100 help maintain traction when a wearer is moving or standing on uphill terrain (e.g., because a wearer typically will lean forward and/or put more weight on his/her toes to help maintain his/her balance, the substantially perpendicular walls 162 will engage the ground and help provide traction). In a similar manner, the rear traction elements 150 at the heel portion of the sole structure help maintain traction when a wearer is moving or standing on downhill terrain (e.g., because a wearer typically will lean backward and/or put more weight on his/her heels to help maintain his/her balance, the substantially perpendicular walls 152 will engage the ground and help provide traction). Additionally, because of the weight shift from front to rear and vice versa (e.g., during step and landing activities while walking, running, swinging, etc.), movement of some portions of the sole structure 100 with respect to other portions thereof about the lateral recessed segments 110*a*, 110*b*, 110*c*, 110*d*, 110*e*, and/or 110*f* enables more of the sole structure 100 to stay in contact with the ground (e.g., as compared to the degree of contact with a non-flexible and/or stiff outsole structure), in a manner similar to that described above for the longitudinal recessed segments 108.

Features and aspects of this invention may be applied to a wide variety of shoes or other foot-receiving devices, particularly shoes and other foot-receiving devices used when a swinging motion is made (e.g., golf shoes, baseball or softball shoes, cricket shoes, field hockey shoes, devices for holding the feet used in video game play, etc.).

D. Conclusion

While the invention has been described with respect to specific examples including presently preferred modes of carrying out the invention, those skilled in the art will appreciate that there are numerous variations, combinations, and permutations of the above described structures. Moreover, various specific structural features included in the above examples merely represent examples of structural features that may be included in some examples of structures according to the invention. Those skilled in the art will understand that various specific structural features may be omitted and/or modified in a footwear or other foot-receiving device product without departing from the invention. Thus, the reader should understand that the spirit and scope of the invention should be construed broadly as set forth in the appended claims.

I claim:

1. A sole structure for an article of footwear, comprising:

an outsole member including a contact surface and an interior surface opposite the contact surface, wherein the contact surface includes:

a base level, a first recessed segment formed in the base level and extending toward the interior surface and in a longitudinal direction in a forefoot portion of the outsole member, a second recessed segment formed in the base level and extending toward the interior surface and in the longitudinal direction in the forefoot portion, and a third recessed segment formed in the base level and extending toward the interior surface and in the longitudinal direction in a heel portion of the outsole member, a front end of the third recessed segment being spaced from a rear end of the first recessed segment by a portion of the base level having no recessed segments formed therein, wherein the first and second recessed segments provide lines of flex in the outsole member and divide the forefoot portion of the outsole member into a medial region, a central region, and a lateral region, wherein the medial, central, and lateral regions are movable about the lines of flex to independently engage and disengage from a surface as a dynamic force moves laterally across the interior surface.

2. A sole structure according to claim 1, wherein the contact surface further includes a fourth recessed segment extending toward the interior surface and in a lateral direction in the heel portion.

3. A sole structure according to claim 1, wherein the contact surface further includes a third recessed segment extending toward the interior surface and in a lateral direction in the forefoot portion of the outsole member.

4. A sole structure according to claim 1, further comprising:

a first material included in the first recessed segment, and a second material included in the second recessed segment.

5. A sole structure according to claim 1, further comprising:

a first set of traction members in the forefoot portion, the first set of traction members configured to inhibit forefoot movement in a lateral direction.

6. A sole structure according to claim 5, further comprising:

a second set of traction members in a heel portion of the outsole member, the second set of traction members configured to inhibit heel movement in a medial direction.

7. A sole structure according to claim 1, further comprising:

a first set of traction members in a heel portion of the outsole member, the first set of traction members configured to inhibit heel movement in a medial direction.

8. A sole structure according to claim 1, further comprising:

an impact-attenuating member engaged with the interior surface of the outsole member.

9. A sole structure according to claim 8, wherein the impact-attenuating member includes:

a first major surface at least partially engaged with the interior surface of the outsole member, and a second major surface opposite the first major surface, and wherein the second major surface of the impact-attenuating member includes a first line of flex corresponding to a location of the first recessed segment and a second line of flex corresponding to a location of the second recessed segment.

10. A sole structure according to claim 1, wherein the interior surface includes a first line of flex corresponding to a location of the first recessed segment and a second line of flex corresponding to a location of the second recessed segment.

11. A sole structure according to claim 1, further comprising:

an innersole board engaged with the interior surface.

12. A sole structure according to claim 11, wherein the innersole board includes:

a first major surface at least partially engaged with the interior surface, and a second major surface opposite the first major surface, and wherein the second major surface of the innersole board includes a first line of flex corresponding to a location of the first recessed segment and a second line of flex corresponding to a location of the second recessed segment.

13. A sole structure according to claim 12, further comprising:

a midsole member engaged with the innersole board, wherein the midsole member includes:

a first major surface at least partially engaged with the second major surface of the innersole board, and a second major surface opposite the first major surface of the midsole member.

14. A sole structure according to claim 13, wherein the second major surface of the midsole member includes a first line of flex corresponding to a location of the first recessed segment and a second line of flex corresponding to a location of the second recessed segment, and wherein the second major surface of the innersole board includes a first line of flex corresponding to a location of the first recessed segment and a second line of flex corresponding to a location of the second recessed segment.

15. A sole structure according to claim 1, wherein the sole structure is a sole structure for a golf shoe.

16. A sole structure for an article of footwear, comprising:

an exterior surface including a forefoot portion, a heel portion, a lateral side, and a medial side, wherein the exterior surface includes a first recessed segment extending in a longitudinal direction in the forefoot portion and a second recessed segment extending in the longitudinal direction in the forefoot portion and a third recessed segment extending in the longitudinal direction in the heel portion, a front end of the third recessed segment being spaced from a rear end of the first recessed segment by a portion of the exterior surface having no recessed segments formed therein, and wherein the first and second recessed segments provide lines of flex in the sole structure and divide the forefoot portion of the sole structure into a medial region, a central region, and a lateral region;

a first set of traction members in the forefoot portion, the first set of traction members configured to inhibit forefoot movement in a lateral direction while allowing forefoot movement in a medial direction, wherein the medial, central, and lateral regions of the forefoot portion of the sole structure are movable about the lines of flex to independently engage and disengage subsets of the first set of traction members from a surface as a dynamic force moves laterally across an interior surface of the sole structure; and a second set of traction members in the heel portion, the second set of traction members configured to inhibit heel movement in the medial direction while allowing heel movement in the lateral direction.

17. A sole structure according to claim 16, further comprising:

a first material included in the first recessed segment, and a second material included in the second recessed segment.

18. A sole structure according to claim 16, wherein an interior surface of the sole structure opposite the exterior surface includes a first line of flex corresponding to a location of the first recessed segment and a second line of flex corresponding to a location of the second recessed segment.

19. A sole structure according to claim 16, further comprising:

a midsole member engaged with an interior surface of the sole structure.

20. A sole structure according to claim 16, further comprising:

an innersole board engaged with an interior surface of the sole structure.

21. A sole structure according to claim 20, further comprising:

a midsole member engaged with the innersole board.

22. A sole structure according to claim 16, further comprising:

a heel impact-attenuating element engaged with the heel portion.

23. A sole structure according to claim 22, further comprising:

an innersole board engaged with the heel impact-attenuating element.

24. A sole structure according to claim 23, further comprising:

an impact-attenuating member engaged with the innersole board.

25. A sole structure according to claim 16, wherein the sole structure is a sole structure for a golf shoe.

26. An article of footwear, comprising:

an upper member; and a sole structure engaged with the upper member, the sole structure including an outsole member having a contact surface and an interior surface opposite the contact surface, wherein the contact surface includes:

a base level, a first recessed segment formed in the base level and extending toward the interior surface and in a longitudinal direction in a forefoot portion of the outsole member a second recessed segment formed in the base level and extending toward the interior surface and in the longitudinal direction in the forefoot portion, and a third recessed segment formed in the base level and extending toward the interior surface and in the longitudinal direction in a heel portion of the outsole member, a front end of the third recessed segment being spaced from a rear end of the first recessed segment by a portion of the base level having no recessed segments formed therein, wherein the first and second recessed segments provide lines of flex in the outsole member and divide the forefoot portion of the outsole member into a medial region, a central region, and a lateral region, wherein the medial, central, and lateral regions are movable about the lines of flex to independently engage and disengage from a surface as a dynamic force moves laterally across the interior surface.

27. An article of footwear according to claim 26, wherein the contact surface further includes a first material in the first recessed segment, and a second material in the second recessed segment.

28. An article of footwear according to claim 26, wherein the sole structure further includes a first set of traction members in the forefoot portion, the first set of traction members configured to inhibit forefoot movement in a lateral direction.

29. An article of footwear according to claim 28, wherein the sole structure further includes a second set of traction members in a heel portion of the outsole member, the second set of traction members configured to inhibit heel movement in a medial direction.

30. An article of footwear according to claim 26, wherein the sole structure further includes a first set of traction members in a heel portion of the outsole member, the first set of traction members configured to inhibit heel movement in a medial direction.

31. An article of footwear according to claim 26, wherein the sole structure further includes an impact-attenuating member engaged with the interior surface of the outsole member, wherein the impact-attenuating member includes:

a first major surface at least partially engaged with the interior surface of the outsole member, and a second major surface opposite the first major surface, and wherein the second major surface of the impact-attenuating member includes a first line of flex corresponding to a location of the first recessed segment and a second line of flex corresponding to a location of the second recessed segment.

32. An article of footwear according to claim 26, wherein the interior surface includes a first line of flex corresponding to a location of the first recessed segment and a second line of flex corresponding to a location of the second recessed segment.

33. An article of footwear according to claim 26, wherein the sole structure further includes an innersole board engaged with the interior surface, wherein the innersole board includes:

a first major surface at least partially engaged with the interior surface of the outsole member, and a second major surface opposite the first major surface of the innersole board, and wherein the second major surface of the innersole board includes a first line of flex corresponding to a location of the first recessed segment and a second line of flex corresponding to a location of the second recessed segment.

34. An article of footwear according to claim 33, wherein the sole structure further includes a midsole member engaged with the innersole board, wherein the midsole member includes:

a first major surface at least partially engaged with the second major surface of the innersole board, and a second major surface opposite the first major surface of the midsole member, and wherein the second major surface of the midsole member includes a first line of flex corresponding to a location of the first recessed segment and a second line of flex corresponding to a location of the second recessed segment, and wherein the second major surface of the innersole board includes a first line of flex corresponding to a location of the first recessed segment and a second line of flex corresponding to a location of the second recessed segment.

35. An article of footwear according to claim 26, wherein the article of footwear is a golf shoe.

36. An article of footwear for an article of footwear, comprising:

an upper member; and a sole structure engaged with the upper member, the sole structure including:

an exterior surface including a forefoot portion, a heel portion, a lateral side, and a medial side, wherein the exterior surface includes a first recessed segment extending in a longitudinal direction in the forefoot portion and a second recessed segment extending in the longitudinal direction in the forefoot portion and a third recessed segment extending in the longitudinal direction in the heel portion, a front end of the third recessed segment being spaced from a rear end of the first recessed segment by a portion of the exterior surface having no recessed segments formed therein, and wherein the first and second recessed segments provide lines of flex in the sole structure and divide the forefoot portion of the sole structure into a medial region, a central region, and a lateral region;

a first set of traction members in the forefoot portion, the first set of traction members configured to inhibit forefoot movement in a lateral direction while allowing forefoot movement in a medial direction, wherein the medial, central, and lateral regions of the forefoot portion of the sole structure are movable about the lines of flex to independently engage and disengage subsets of the first set of traction members from a surface as a dynamic force moves laterally across an interior surface of the sole structure; and a second set of traction members in the heel portion, the second set of traction members configured to inhibit heel movement in the medial direction while allowing heel movement in the lateral direction.

37. An article of footwear according to claim 36, wherein the exterior surface further includes a first material in the first recessed segment and a second material in the second recessed segment.

38. An article of footwear according to claim 36, wherein an interior surface of the sole structure opposite the exterior surface includes a first line of flex corresponding to a location of the first recessed segment and a second line of flex corresponding to a location of the second recessed segment.

39. An article of footwear according to claim 36, wherein the sole structure further includes a midsole member engaged with an interior surface of the sole structure.

40. An article of footwear according to claim 36, wherein the sole structure further includes an innersole board engaged with an interior surface of the sole structure.

41. An article of footwear according to claim 40, wherein the sole structure further includes a midsole member engaged with the innersole board.

42. An article of footwear according to claim 36, wherein the sole structure further includes a heel impact-attenuating element engaged with the heel portion.

43. An article of footwear according to claim 42, wherein the sole structure further includes an innersole board engaged with the heel impact-attenuating element.

44. An article of footwear according to claim 43, wherein the sole structure further includes an impact-attenuating member engaged with the innersole board.

45. An article of footwear according to claim 36, wherein the article of footwear is a golf shoe.

* * * * *